United States Patent [19]

Oshimura et al.

[11] 4,133,676

[45] Jan. 9, 1979

[54] ACICULAR FERROMAGNETIC METAL PARTICLES AND METHOD FOR PREPARATION OF THE SAME

[75] Inventors: Masakazu Oshimura; Kenichi Yokoyama; Yukihiro Hayashi; Akira Miyake, all of Ibaraki, Japan

[73] Assignee: Hitachi Maxell, Ltd., Ibaraki, Japan

[21] Appl. No.: 861,514

[22] Filed: Dec. 16, 1977

[30] Foreign Application Priority Data

Dec. 20, 1976 [JP] Japan ..... 51-153838

[51] Int. Cl.[2] ..... H01F 1/06

[52] U.S. Cl. ..... 75/0.5 AA; 75/251; 148/31.55; 148/105

[58] Field of Search ..... 75/0.5 AA, 251; 148/105, 31.55

[56] References Cited

U.S. PATENT DOCUMENTS

| | | | |
|---|---|---|---|
| 3,206,338 | 9/1965 | Miller et al. | 148/105 |
| 3,598,568 | 8/1971 | Klomp et al. | 148/105 |
| 3,679,398 | 7/1972 | Geus | 75/0.5 AA |
| 4,056,410 | 11/1977 | Corradi et al. | 148/105 |
| 4,063,000 | 12/1977 | Aonuma et al. | 148/105 |

*Primary Examiner*—W. Stallard

*Attorney, Agent, or Firm*—Birch, Stewart, Kolasch and Birch

[57] ABSTRACT

Acicular ferromagnetic metal particles having a particle size of 0.1 to 1 μm and a dimension of crystallite-size of not more than about 215 Å in the effective thickness of the crystallite in the direction perpendicular to the reflecting plane (110), which have a high coercive force, preferably not less than 1,400 oersteds and are useful for a high-density magnetic recording tape, video mother tape, or permanent magnet material, and a method for the preparation of the ferromagnetic metal particles comprising reducing with heating goethite particles which are prepared by treating a ferrous salt with a large amount of a basic agent, particularly an alkali metal hydroxide.

12 Claims, 2 Drawing Figures

ACICULAR FERROMAGNETIC METAL PARTICLES AND METHOD FOR PREPARATION OF THE SAME

BACKGROUND AND SUMMARY OF THE INVENTION

The present invention relates to acicular ferromagnetic metal particles having a high coercive force and a method for the preparation thereof. More particularly, it relates to acicular ferromagnetic metal particles having a particle size of 0.1 to 1 μm and a dimension of crystallite-size of not more than about 215 Å in the effective thickness of the crystallite in the direction perpendicular to the reflecting plane (110) which have a high coercive force, preferably not less than 1,400 oersteds, and are useful for a high-density magnetic recording tape, video mother tape, or permanent magnet material, and a method for the preparation of the acicular ferromagnetic metal particles from specific α-ferric oxy-hydroxide particles.

The ferromagnetic metal particles comprises mainly iron element but may contain a small amount of other metal elements such as nickel, chromium, cobalt, copper, or the like in order to prevent oxidation of the particles. The ferromagnetic metal particles are hereinafter referred to merely as "ferromagnetic iron particles".

Generally, the ferromagnetic iron particles tend to have a higher coercive force with smaller particle size similar to the usual magnetic particles. From a practical viewpoint, however, the magnetic particles, particularly useful for magnetic recording medium, should have a particle size of 0.1 to 1 μm because of easy handling (e.g. for prevention of combustion) and the better dispersibility into binders. Such practical magnetic particles have merely a lower coercive force than 1,000 oersteds, usually 500 to 800 oersteds.

For instance, according to a reduction method using an alkali metal borohydride, which is a representative method among the conventional methods for preparing ferromagnetic iron particles, there can merely be produced ferromagnetic iron particles having more than 1,000 oersteds only when the particle size thereof is not larger than 0.04 μm (cf. U.S. Pat. No. 3,865,627). Thus, in the practical particle size as mentioned above, any ferromagnetic iron particle having a high coercive force has never been prepared by the conventional method.

It has recently been reported that ferromagnetic iron particles having a coercive force of 800 to 1,300 oersteds could be prepared by using a specific agent for prevention of sintering in a method for preparing iron particles comprising reducing with heating powdery materials to be reduced such as a metal iron oxide or oxalate (cf. U.S. Pat. No. 3,607,220). According to this method using an agent for prevention of sintering, however, the ferromagnetic iron particles thus obtained have unfavorable defects. For instance, when a magnetic paint is prepared from the ferromagnetic iron particles, the agent for prevention of sintering is reacted with resins used as a binder to cause gelation of the paint, and hence, such ferromagnetic iron particles are unfavorable as magnetic materials.

The present inventors have already found that ferromagnetic iron particles having the desired particle shape, e.g. having a good acicularity, can generally be prepared by reducing with heating an α-ferric oxyhydroxide particle [FeO(OH)] (hereinafter, referred to as "geothite particle") with a reducing agent, wherein a goethite particle prepared by a specific method is used.

The goethite particles are usually prepared by adding a basic agent, which is used for the purpose of precipitating ferrous hydroxide or insoluble ferrous salts, to an aqueous solution of ferrous salts and then introducing an oxygen-containing gas into the mixture. The present inventors have found that when the goethite particles are prepared by carrying out the above reaction in a specific alkali solution, the goethite particles can be reduced with heating without sintering thereof and thereby the original shape of the goethite particles can almost be maintained as is.

Aiming at the fact that the ferromagnetic iron particles prevented from sintering have a higher coercive force than that of the conventional ferromagnetic iron particles, further extensive studies have been effected. As a result, it has now been found that the desired ferromagnetic iron particles having an extremely high coercive force can be prepared from specific goethite particles which are prepared by using a fixed large amount of the basic agent.

An object of the present invention is to provide improved ferromagnetic iron particles having a high coercive force.

Another object of the invention is to provide ferromagnetic iron particles having a coercive force of more than 1,400 oersteds useful, particularly, as a high-density magnetic recording medium.

A further object of the present invention is to provide an improved method for the preparation of ferromagnetic iron particles having a high coercive force.

These and other objects of the invention will be apparent from the following disclosure.

According to the present invention, the desired ferromagnetic iron particles having a high coercive force can be prepared by reducing with heating goethite particles which are prepared by treating an aqueous solution of a ferrous salt with a large amount of a basic agent and followed by oxidation of the resulting reaction mixture.

That is, the goethite particles are prepared by adding with agitation an aqueous solution of a ferrous salt to an aqueous solution of a basic agent, so that the pH value of the mixture becomes not less than about 12, preferably not less than about 13.5, whereby ferrous hydroxide being precipitated, and then blowing an oxygen-containing gas (e.g. air) into the reaction mixture at room temperature or an elevated temperature (e.g. at 20–80° C.), whereby ferrous hydroxide being oxidized to produce goethite, and isolating the precipitated goethite particles, washing with water and then drying.

The starting ferrous salt includes ferrous sulfate, ferrous chloride, ferrous bromide, ferrous acetate and is usually used in an amount of 0.2 to 0.5 mol/l based on the whole volume of the reaction mixture after adding the basic agent. The basic agent includes alkali metal hydroxides or carbonates (e.g. sodium hydroxide, potassium hydroxide, lithium hydroxide, sodium carbonate, potassium carbonate, lithium carbonate), alkaline earth metal hydroxides (e.g. calcium hydroxide, magnesium hydroxide, strontium hydroxide) and ammonium hydroxide, but alkali metal hydroxides are the most preferable from the viewpoint of the solubility and the pH value of the solution as explained hereinafter. The basic agent may be used in an amount of not less than 6 mol, preferably not less than 8 mol, more preferably not less than 10 mol, per 1 mol of the ferrous salt, The upper limit of the amount may be restricted by the solubility of the basic agent, and hence, the amount of the basic agent is usually in the range of 6 to 80 mol, preferably 8 to 30 mol, more preferably 10 to 20 mol, per 1 mol of the ferrous salt.

In the preparation of the goethite particles, a small amount of salts of other metals may be added to the aqueous solution of a ferrous salt. Suitable examples of other metal salts are sulfate, chloride, bromide or acetate of nickel, chromium, cobalt or copper, and these salts may usually be used in an amount of a few to several percents by weight based on the weight of the ferrous salts. The geothite particles containing other metal components can give the ferromagnetic iron particles having excellent anti-oxidation properties by treating it as described below.

The goethite particles thus obtained are dehydrated with heating at about 200 to 800° C., whereby $\alpha$-ferric oxide is produced, and the resulting ferric oxide is reduced with a reducing gas (e.g. hydrogen gas) at a temperature of about 340° to 420° C., by which the desired ferromagnetic iron particles having a high coercive force can be obtained.

Referring to the accompanying drawings, the present invention will be explained in more detail below.

Figure 1:
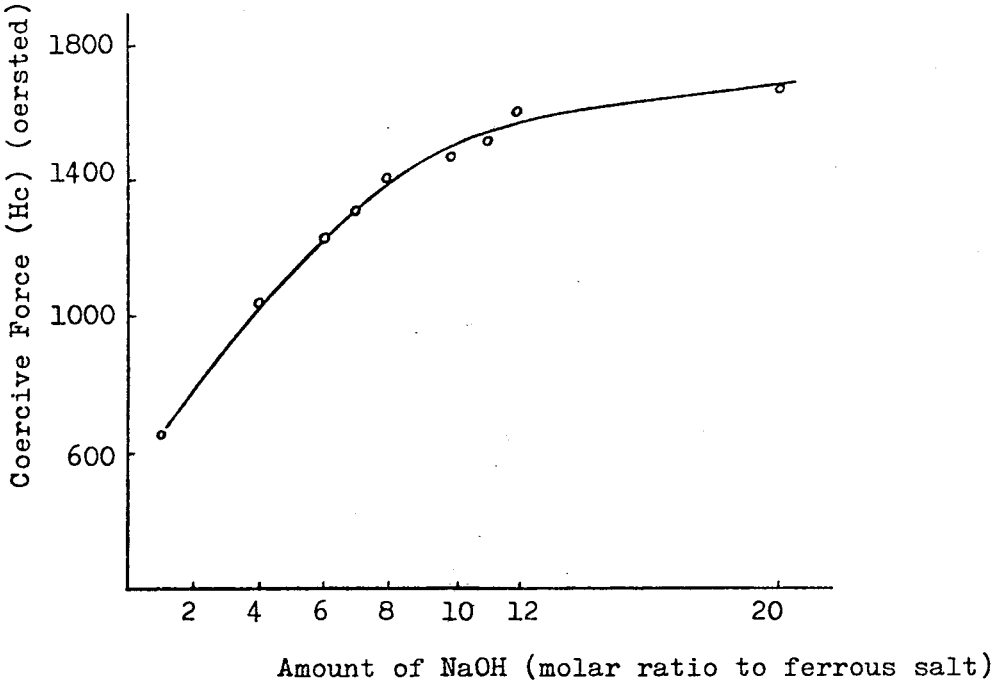
FIG. 1 shows a relation between the coercive force (Hc) of the ferromagnetic iron particles and the amount of sodium hydroxide (NaOH) (a basic agent), when the ferromagnetic iron particles are prepared by reducing goethite particles prepared by using sodium hydroxide at 360° C., wherein the ferromagnetic iron particles have a particle size of 0.1 to 1 $\mu$m.

As is clear from FIG. 1, a proportionality is present between the amount of sodium hydroxide and the coercive force of the ferromagnetic iron particles, and when sodium hydroxide is used in an amount of not less than 6 mol, not less than 8 mol or not less than 10 mol per 1 mol of the starting ferrous salt, the resulting ferromagnetic iron particles exhibits a high coercive force of not less than 1,200 oersteds, not less than 1,400 oersteds and not less than 1,500 oersteds, respectively.

The above proportionality is observed in case of using other alkali metal hydroxides such as potassium hydroxide (KOH), lithium hydroxide (LiOH). On the other hand, in case of ammonium hydroxide ($NH_4OH$), or sodium carbonate ($Na_2CO_3$), such a significant effect is not observed. This fact implies that increase of the coercive force is dependent upon the pH value of the reaction mixture and when the pH value can not be increased to 12 or more, even if the amount of the alkali is increased, no significant effect can be achieved. Besides, in case of alkaline earth metal hydroxides, such as calcium hydroxide ($Ca(OH)_2$), magnesium hydroxide ($Mg(OH)_2$), or strontium hydroxide ($Sr(OH)_2$), they have a low solubility in water and the concentration thereof can not be increased till 8 mol per 1 mol of the ferrous salt, and hence, the increase of the coercive force is limited.

The present inventors have intensively studied the reason why the coercive force of ferromagnetic iron particles is increased with increase of the amount of alkali in an alkaline reaction mixture (e.g. at a pH value of more than 12). As a result, it has been found that the ferromagnetic iron particles having so high coercive force have an extremely small dimension of crystallite-size and this small dimension of crystallite-size give an effect on the increase of the coercive force.

Figure 2:
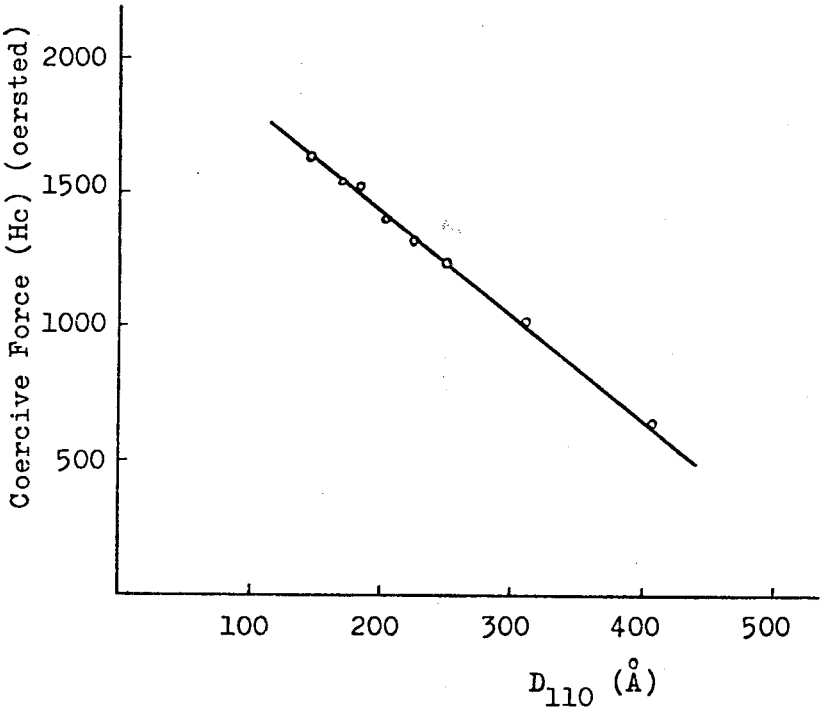
FIG. 2 shows a correlation between the coercive force (Hc) of ferromagnetic iron particles and the dimension of crystallite size.

FIG. 2 shows a correlation between the coercive force (Hc) of ferromagnetic iron particles having a particle size of 0.1 to 1 $\mu$m prepared in various amounts of a basic agent and the dimension of crystallite-size calculated by the Scherrer's crystallite-size equation as explained below. The dimension is shown by the effective thickness of the crystallite in the direction perpendicular to the reflecting plane (110). This dimension is hereinafter, referred to as "$D_{110}$".

$D_{110}$ is determined from X-ray diffraction line broadening measurement using the following Scherrer's crystallite-size equation:

$$D_{110} = (K\lambda/\beta \cos\theta) \qquad \text{(VIII)}$$

wherein $\beta$ is the pure X-ray diffraction broadening, K is Scherrer's constant (0.9), $\lambda$ is a wavelength of FeK$\alpha$ X-ray (1.935 Å) and $\theta$ is a diffraction angle.

In the determination of the $\beta$ value, the following approximate equations are made from the correlation curve (a) of the angular separation of K$\alpha_1$ and K$\alpha_2$ to the diffraction angle ($2\theta$) of K$\alpha$-ray with respect to iron (Fe), the correction curve (b) for correcting line breadths for K$\alpha_1$ and K$\alpha_2$ broadening, and the correction curve (c) for correcting X-ray spectrometer line breadths for instrumental broadening.

The correlation curve (a), correction curve (b) and correction curve (c) are the curves disclosed as FIG. 9-6 on page 505, FIG. 9-5 on page 504 and FIG. 9-7 on page 508, respectively of H. P. Klug, L. E. Alexander, "X-ray Diffraction Procedures for Polycrystalline and Amorphous Materials", John Wiley & Sons, Inc., New York (1954).

That is, under the definitions that (B) is the breadth of a diffraction line of the test sample eliminating the effect of K$\alpha_2$, ($B_o$) is the experimentally observed breadth of a diffraction line of the test sample, (b) is a breadth of diffraction line of the standard material eliminating the effect of K$\alpha_2$, ($b_o$) is the experimentally observed breadth of a diffraction line of the standard material and ($\delta$) is an angular separation of K$\alpha_1$ and K$\alpha_2$, the following equations are made:

(1) based on the correlation curve (a), $$\delta = 1.624 \times 10^{-7}(\theta)^3 - 1.303 \times 10^{-5}(\theta)^2 + 2.654 \times 10^{-3}(\theta) - 5.666 \times 10^{-3} \qquad \text{(I)}$$

(2) based on the correction curve (b), (in case of $\delta/B_o < 0.5$)

$$B/B_o = -1.375(\delta/B_o)^2 + 0.117(\delta/B_o) + 1.000 \qquad \text{(II)}$$

(in case of $\delta/B_o > 0.5$)

$$B/B_o = -1.133(\delta/B_o) + 1.2766 \qquad \text{(III)}$$

(in case of $\delta/b_o < 0.5$)

$$b/b_o = 1.375(\delta/b_o)^2 + 0.1117(\delta/b_o) + 1.000 \qquad \text{(IV)}$$

(in case of $\delta/b_o > 0.5$)

$$b/b_o = 1.133(\delta/b_o) + 1.2766 \qquad \text{(V)}$$

(3) based on the correction curve (c), (in case of $b/B < 0.4$)

$$\beta/B = -1.2859(b/B)^2 - 0.2257(b/B) + 1.000 \qquad \text{(VI)}$$

(in case of $b/B > 0.4$)

$$\beta/B = -1.1666(b/B) + 1.1666 \qquad \text{(VII)}$$

The breadths ($B_o$) and ($b_o$) of observed diffraction lines are substituted into the approximate equations (II) to (V) according to the ($\delta$) value calculated from the approximate equation (I) to obtain the breadths (B) and (b) eliminating the effect of K$\alpha_2$, and then, these values are substituted into the approximate equations (VI) and (VII) according to the ratio of these values, by which the pure X-ray diffraction broadening ($\beta$) is calculated.

$D_{110}$ is calculated by substituting the $\beta$ value thus calculated into the equation (VIII) as mentioned above.

As is clear from FIG. 2, there is a linear relationship between the coercive force (Hc) and $D_{110}$. That is, when $D_{110}$ is smaller, in other words, when the growth of crystals is inhibited, the coercive force becomes extremely high. For instance, when $D_{110}$ is not more than 200 Å, the coercive force is not less than 1,400 oersteds, when $D_{110}$ is not more than 180 Å, the coercive force is not less than 1,500 oersteds.

In FIG. 2, the particles having $D_{110}$ of 320–350 Å and hence having a coercive force of less than about 1,000 oersteds are the conventional ferromagnetic iron particles, which means that the ferromagnetic iron particles obtained by the conventional methods have a fairly large degree of growth of crystals.

Besides, the particles having $D_{110}$ of 220–230 Å prepared by using a specific agent for prevention of sintering as mentioned hereinbefore show a coercive force of about 1,000 to 1,300 oersteds, which may be owing to inhibition of growth of crystals by the specific agent for prevention of sintering.

Thus, according to the present invention, the dimension of crystallite-size of the iron particles formed during the reduction step of goethite particles can be optionally varied by controlling the amount of the basic agent, particularly, an alkali metal hydroxide in the preparation of goethite particles, and thereby, the desired ferromagnetic iron particles having a high coercive force can be prepared. When the alkali metal hydroxide is used in an amount of not less than 8 mol per 1 mol of the starting ferrous salt, the obtained ferromagnetic iron particles have a coercive force of not less than 1,400 oersteds at $D_{110}$ of less than 200 Å in the practical particle size of 0.1 to 1 μm and are useful, particularly, as magnetic recording medium, and when the alkali metal hydroxide is used in an amount of not less than 10 mol per 1 mol of the starting ferrous salt, the obtained ferromagnetic iron particles have a coercive force of not less than 1,500 oersteds at $D_{110}$ of less than 180 Å in the same particle size. Such ferromagnetic iron particles having an extremely high coercive force have never been found.

Besides, when the alkali metal hydroxide is used in an amount of not less than 6 mol per 1 mol of the starting ferrous salt, ferromagnetic iron particles having a coercive force of 1,000 to 1,300 oersteds at $D_{110}$ of 220 to 320 Å can be prepared according to the method of the present invention, and it has been reported that ferromagnetic iron particles having such a high coercive force could be prepared by using a specific agent for prevention of sintering as mentioned hereinbefore. However, the ferromagnetic iron particles obtained by the present invention do not show such a defect as the reaction with a binder owing to the agent for prevention of sintering as is observed in the known ferromagnetic iron particles.

The ferromagnetic iron particles obtained by the present invention are contained with alkali metals derived from the basic agents used in the preparation of goethite particles and futher have an axis ratio (long axis/short axis) and a particle size which approximately correspond to the axis ratio and the particle size of the goethite particles.

The axis ratio of the goethite particles is mainly owing to the amount of the basic agents (e.g. alkali metal hydroxides), and when the amount of the basic agents is not less than 8 mol per 1 mol of the ferrous salt, the axis ratio (long axis/short axis) of goethite particles is more than about 5, preferably 10 to 20, and the higher the amount of the basic agents, the larger the axis ratio.

The particle size of the goethite particles is mainly owing to the concentration of the ferrous salt, and when the concentration of the ferrous salt is in the range of 0.2 to 0.5 mol/l based on the whole volume of the reaction mixture, there can stably be prepared goethite particles having a particle size of 0.1 to 1.0 μm.

The ferromagnetic iron particles of the present invention have so high coercive force and also have a maximum magnetization ($\sigma s$) of about double that of the conventional barium ferrite which is known as a magnetic material having a high coercive force, for instance, a maximum magnetization of more than 120 emu/g (The maximum magnetization ($\sigma s$) is measured in the magnetic filed of 10,000 oersteds by using a vibrating sample magnetometer). Generally speaking, unless the maximum magnetization ($\sigma s$) is more than 120 emu/g, there is hardly obtained the ferromagnetic iron particles having a coercive force of 1,000 oersteds.

Thus the desired ferromagnetic iron particles of the present invention have $D_{110}$ of not more than about 215 Å, preferably 140 to 200 Å, and then have a coercive force of about 1,000 to 2,000 oersteds, preferably about 1,400 to 1,700 oersteds, and a $\delta s$ of about 120 to 210 emu/g, preferably 129 to 150 emu/g, and are useful for a high-density magnetic recording tape, video mother tape, permanent magnet material, or the like.

The present invention is illustrated by the following Examples but is not limited thereto.

EXAMPLE 1

To a 5 liter glass-made vessel were added NaOH (800 g, 20 mol) and water (2 liters) and thereto was added with vigorous agitation a solution of ferrous sulfate ($FeSO_4.7H_2O$, 278 g, 1 mol) in water (2 liters) to precipitate white green ferrous hydroxide.

While keeping the solution containing the precipitates at 40° C., air was blown into the solution at a rate of 20 liter/minute for 10 hours in order to oxidize the ferrous hydroxide. The resulting yellow precipitates were separated by filtration, washed well with water and then dried at 100° C. to give acicular goethite particles having a particle size (average length in long axis: 0.4 μm) and an axis ratio (long axis/short axis: 15/1).

The goethite particles obtained above were dehydrated by heating at 500° C. to give $\alpha$-ferric oxide ($\alpha$-$Fe_2O_3$). The $\alpha$-ferric oxide (5 g) was uniformly developed onto a quartz board. The board was set within an electric furnace and thereto was passed through hydrogen gas in a rate of 1 liter/minute at 360° C. for 6 hours and thereby the ferric oxide was reduced to give ferromagnetic iron particles (Product No. 1).

The particles had almost the same particle size and axis ratio as those of goethite particles and had a $D_{110}$ of 140 Å which was measured by an X-ray diffraction. The particles had also a coercive force (Hc) of 1,700 oersteds which was measured at a maximum magnetic field of 10,000 oersteds by using a vibrating sample magnetometer, a maximum magnetization ($\sigma s$) of 146 emu/g and a square ratio (residual magnetization/maximum magnetization: $\sigma r/\sigma s$) of 0.50.

In the same manner as described above excepting that the amount (molar ratio to that of ferrous sulfate) of NaOH was varied, various ferromagnetic iron particles (Product Nos. 2 to 9) were prepared, and the particle size, $D_{110}$ and coercive force of these particles were measured. The results are shown in the following Table 1.

Table 1

| Product No. | Amount of NaOH (molar ratio) | Particle size (μm) | $D_{110}$ (Å) | Hc (oersted) |
|---|---|---|---|---|
| 2 | 1 | 0.2 | 410 | 660 |
| 3 | 4 | 0.3 | 310 | 1000 |
| 4 | 6 | 0.6 | 250 | 1250 |
| 5 | 7 | 0.5 | 225 | 1320 |
| 6 | 8 | 0.6 | 200 | 1420 |
| 7 | 10 | 0.3 | 180 | 1500 |
| 8 | 11 | 0.3 | 170 | 1540 |
| 9 | 12 | 0.2 | 145 | 1620 |

FIG. 1 and FIG. 2 are drawn based on the data obtained above, wherein the correlation between the amount of NaOH and Hc and also the correlation between $D_{110}$ and Hc are shown.

EXAMPLE 2

In the same manner as described in Example 1 excepting that the amount of NaOH was varied to 1 mol, 4 mol, 10 mol or 20 mol and the temperature for the reduction was changed, various ferromagnetic iron particles (Product Nos. 10 to 23) were prepared, and the characteristics thereof were measured. The results are shown in the following Table 2.

Table 2

| Product No. | Amount of NaOH (molar ratio) | Reduction temperature (° C) | Particle size (μm) | $D_{110}$ (Å) | Hc (oersted) | σs (emu/g) | σr/σs ca |
|---|---|---|---|---|---|---|---|
| 10 | | 340 | 0.2 | 390 | 690 | 135 | 0.32 |
| 11 | 1 | 380 | 0.3 | 415 | 610 | 159 | 0.28 |
| 12 | | 400 | 0.3 | 435 | 510 | 163 | 0.24 |
| 13 | | 340 | 0.3 | 300 | 1050 | 122 | 0.47 |
| 14 | 4 | 380 | 0.3 | 300 | 1040 | 162 | 0.46 |
| 15 | | 400 | 0.3 | 300 | 1040 | 162 | 0.46 |
| 16 | | 340 | 0.3 | 190 | 1460 | 129 | 0.50 |
| 17 | 10 | 380 | 0.3 | 185 | 1490 | 145 | 0.50 |
| 18 | | 400 | 0.3 | 190 | 1470 | 146 | 0.50 |
| 19 | | 420 | 0.3 | 200 | 1410 | 146 | 0.50 |
| 20 | | 340 | 0.3 | 185 | 1490 | 135 | 0.50 |
| 21 | 20 | 380 | 0.3 | 150 | 1630 | 148 | 0.50 |
| 22 | | 400 | 0.3 | 180 | 1500 | 150 | 0.50 |
| 23 | | 420 | 0.3 | 200 | 1420 | 150 | 0.50 |

As is clear from the data shown in the above Table 2, even if the temperature for reduction is changed, there is a close correlation between the amount of NaOH and $D_{110}$ or coercive force, and all Product Nos. 16 to 23 wherein NaOH was used in an amount of 10 mol or 20 mol per 1 mol of ferrous sulfate showed so high coercive force as more than 1,400 oersteds.

EXAMPLE 3

In the same manner as described in Example 1 excepting that KOH (560 g, 10 mol) was used instead of NaOH (800 g, 20 mol), there were prepared acicular goethite particles having a particle size of 0.4 μm and an axis ratio of 10/1. The goethite particles were treated in the same manner as in Example 1 excepting that the temperature for reduction was as shown in the following Table 3 to give ferromagnetic iron particles (Product Nos. 24 to 28), which characteristics were measured likewise. The results are shown in Table 3.

Table 3

| Product No. | Reduction temp. (° C) | Particle size (μm) | $D_{110}$ (Å) | Hc (oersted) | σs (emu/g) | σr/σs |
|---|---|---|---|---|---|---|
| 24 | 340 | 0.3 | — | 580 | 103 | 0.46 |
| 25 | 360 | 0.3 | 170 | 1550 | 141 | 0.50 |
| 26 | 380 | 0.3 | 190 | 1470 | 143 | 0.50 |
| 27 | 400 | 0.3 | 200 | 1420 | 145 | 0.50 |
| 28 | 420 | 0.3 | 215 | 1380 | 145 | 0.50 |

As is clear from the data shown in the above Table 3, even if KOH is used as the basic agent, the ferromagnetic iron particles show so high coercive force as that of the particles prepared by using NaOH.

What is claimed is:

1. An acicular ferromagnetic metal particle comprising iron element as the essential component, which has a particle size of 0.1 to 1 μm and a dimension of crystallite-size of not more than 215 Å in the effective thickness of the crystallite in the direction perpendicular to the reflecting plane (110) ($D_{110}$).

2. The acicular ferromagnetic metal particle according to claim 1, wherein the $D_{110}$ is in the range of 140 to 200 Å.

3. The acicular ferromagnetic metal particle according to claim 1, which has a coercive force of not less than 1,400 oersteds.

4. The acicular ferromagnetic metal particle according to claim 3, wherein the coercive force is in the range of 1,400 to 1,700 oersteds.

5. The acicular ferromagnetic metal particle according to claim 1, which has a maximum magnetization (σs) of not less than 120 emu/g.

6. The acicular ferromagnetic metal particle according to claim 5, wherein the maximum magnetization is in the range of 129 to 150 emu/g.

7. A method for preparation of an acicular ferromagnetic metal particle having a high coercive force, which comprises adding an aqueous solution of a ferrous salt to an aqueous solution of a basic agent for precipitating ferrous hydroxide or insoluble ferrous salt, passing through an oxygen-containing gas to the mixture to produce an α-ferric oxyhydroxide, and reducing the α-ferric oxyhydroxide with heating with a reducing gas, said basic agent being used in an amount of not less than 6 mol per 1 mol of the ferrous salt.

8. The method according to claim 7, wherein the basic agent is an alkali metal hydroxide.

9. The method according to claim 8, wherein the basic agent is a member selected from the group consisting of sodium hydroxide and potassium hydroxide.

10. The method according to claim 8, wherein the basic agent is used in an amount of 8 to 30 mol per 1 mol of the ferrous salt.

11. The method accoding to claim 10, wherein the ferrous salt is used in an amount of 0.2 to 0.5 mol/l based on the whole volume of the reaction mixture.

12. The method according to claim 7, wherein the reduction of α-ferric oxyhydroxide is carried out at a temperature of 340 to 420° C.

* * * * *